United States Patent [19]

Alloway

[11] 4,308,903

[45] Jan. 5, 1982

[54] SLIDING LOG SPLITTER DEVICE

[76] Inventor: Joseph R. Alloway, 11 Great Woods Dr., Trenton, N.J. 08618

[21] Appl. No.: 180,079

[22] Filed: Aug. 21, 1980

[51] Int. Cl.[3] ..... B27L 7/00

[52] U.S. Cl. ..... 144/193 C; 144/193 D; 145/21; 173/91

[58] Field of Search ..... 145/24, 61 E, 21; 30/168, 277; 173/102, 91; 144/193 R, 193 C, 193 D; 254/104

[56] References Cited

U.S. PATENT DOCUMENTS

| | | | |
|---|---|---|---|
| 161,282 | 3/1875 | Russell | 254/19 |
| 776,191 | 11/1904 | Lynch | 145/21 |
| 875,940 | 1/1908 | Mason . | |
| 1,082,379 | 12/1913 | West | 145/24 |
| 3,050,095 | 8/1962 | Prather | 144/193 C |
| 3,313,356 | 4/1967 | Clevenger | 144/193 C |
| 3,519,087 | 7/1970 | Santi | 144/193 C |
| 3,735,822 | 5/1973 | Deike | 144/193 C |
| 4,254,808 | 3/1981 | Nokes | 254/104 |

*Primary Examiner*—W. D. Bray

*Attorney, Agent, or Firm*—John J. Kane; Frederick A. Zoda; Albert Sperry

[57] ABSTRACT

A log splitter device is disclosed using a slide hammer type configuration for the driving of a wedge. The wedge itself defines an abutment surface which includes a shaft member extending outward therefrom. An annular member of generally tubular configuration is configured with the central bore into which extends the shaft member. A weight means is fixedly secured with respect to the annular member to provide added momentum. Two impacting areas are defined by this device such that each impact occurs simultaneously to increase the efficiency of momentum transfer from the weighted annular member to the wedge. An upper impact is achieved by a core member which is fixedly secured within the annular member contacting the upper edge of the shaft member extending through the central bore thereof. A second impact is created by the lower end of the tubular member in direct contact with the abutment surface of the wedge. An adjustment feature may also be included as a wedge spacer to adjust the distances to assure simultaneous impact of the first and second impacting areas.

1 Claim, 2 Drawing Figures

Fig. 1
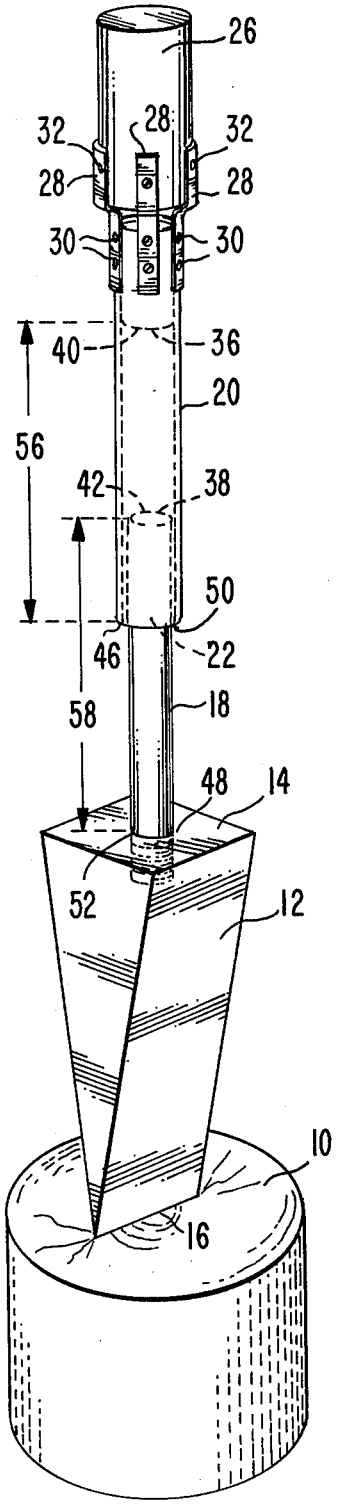
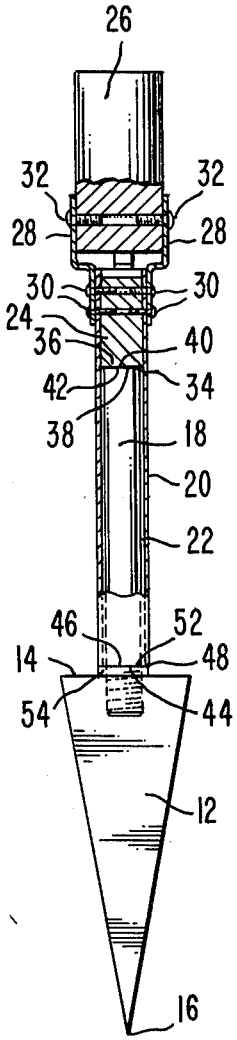
Fig. 2

SLIDING LOG SPLITTER DEVICE

BACKGROUND OF THE INVENTION

1. Field of the Invention

The present invention combines the use of a slide hammer type operation in combination with a driven wedge for log splitting. The present invention provides a novel means for splitting wood without requiring the excess energy and dangers normally associated with swinging an axe. Also the present invention does not have the necessity for external power as in devices such as hydraulic log splitters. The present invention is also much more inexpensive than those devices. To this end the present invention provides a hand tool for splitting of logs which is significantly superior to the normal manipulation of a wedge and an axe.

2. Description of the Prior Art

Many devices utilize the slide hammer design such as shown in U.S. Pat. Nos. 875,940; 776,191; 161,282; and 1,082,379, however, none of these patents show the particular application of usage as in the present invention. Also, none show the dual impacting capability as apparent with the present invention. Most of these devices are merely chisels or implements for various purposes which are percussion driven. The present invention is novel in its application of a hand tool for wood splitting.

SUMMARY OF THE INVENTION

The present invention provides a sliding log splitter device which utilizes a wedge means adapted to be forcibly inserted into a wooden log to cause splitting thereof. This invention is a hand tool which is completely capable of inserting the wedge means into such logs. The wedge means itself may include an abutment surface thereon and a splitting edge. A shaft member is fixedly secured with respect to the abutment surface of the wedge means and extends outwardly therefrom.

An annular member of a generally tubular configuration which could be square or round in cross-section defines a longitudinally extending central bore therein having a cross-sectional internal dimension greater than the cross-sectional external dimension of the shaft member. In this manner the shaft member is allowed to extend through the central bore such that the shaft member and the annular member are slidably engaged with respect to one another.

A core member is fixedly secured within the central bore near the upper end thereof such as to be selectively abuttable with the upper end of the shaft member as the annular member is moved downwardly longitudinally therealong. In this manner an impact will be created between the bottom of the core member and the upper surface of the shaft member for driving of the wedge.

A weight means may be detachably secured with respect to the annular member to provide an increased momentum to that member during movement. A weight retaining bracket means will detachably secure the weight means with respect to the annular member.

To assure complete and full transfer of energy from the slidable member to the shaft member an upper impact means and a lower impact means are provided in the present invention. The upper impact means includes a first upper impact surface defined as the lower face of the core member. The upper impact means also includes a second upper impact surface defined as the upper surface of the shaft means opposite from the location of fixed securement of the shaft means with respect to the wedge means. In this manner the second upper impact surface is adapted to be impacted by the first impact surface by downward movement of the annular member along the core member toward the wedge means.

In a similar fashion, a lower impact surface includes a first lower impact surface comprising the bottom end of the annular member opposite from the point of location to the weight means as well as a second lower impact surface which is a surface of the wedge means itself. This could be the abutment surface of the wedge means or it could be the upper surface of the wedge spacer means if utilized in that particular embodiment. In this manner the lower end of the annular member will contact the wedge means itself to facilitate driving into the wooden log member. The distances here are of significance. The distance from the first upper impact surface to the first lower impact surface must be indentical to the distance between the second upper impact surface and the second lower impact surface in order to cause the lower impact means to contact simultaneously with contact of the upper impact means. In this manner full and efficient transfer of momentum from the weight means and the movable annular member will be transmitted to the shaft member and the wedge means in particular.

It is an object of the present invention to provide a log splitter device which does not require external power and is a simple and expedient hand tool.

It is an object of the present invention to provide a log splitter device which is simple in operation and easy to maintain.

It is an object of the present invention to provide a sliding log splitter device which is of minimal cost with respect to other devices for the splitting of logs.

It is an object of the present invention to provide a log splitter device which makes use of a standardly configured wedge or splitting edge driven by a slide hammer impact design.

It is an object of the present invention to provide a log splitter device which includes two impacting areas to assure full and complete transfer of momentum from the slidable portions thereof to the fixedly positioned wedge means.

It is an object of the present invention to provide a sliding log splitter device wherein the slidable portion is completely removable with respect to the fixedly positioned wedge and shaft.

It is an object of the present invention to provide a sliding log splitter device which includes a weight securement means adapted to detach one weight from the slidable portion and increase the weight or decrease the weight as desired.

It is an object of the present invention to provide a sliding log splitter device which allows adjustment of the distances between the impacting surfaces to assure simultaneous contact thereof during usage.

It is an object of the present invention to provide a log splitter device with a drive shaft of rectangular cross-section to maintain rotational integrity thereof.

It is an object of the present invention to provide a log splitter device with a drive shaft of circular cross-section.

It is an object of the present invention to provide a sliding log splitter device which can effect log splitting by a single person without requiring manipulation of an axe.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 1 is a perspective illustration of an embodiment of a sliding log splitting device of the present invention shown in position in a log; and FIG. 2 is cross-sectional view of another embodiment of the slidable log splitter device of the present invention including a wedge spacer means for varying the spacing between the impacting surfaces.

DETAILED DESCRIPTION OF THE PREFERRED EMBODIMENT

The present invention provides a sliding log splitter device which includes a wedge means 12 which is adapted to be driven into a log 10 as best shown in FIG. 1. The wedge means includes an abutment surface 14 and a splitting edge 16. The splitting edge 16 is adapted to be placed into the log and the abutment surface 14 is on the opposite side of the wedge means 12 from the splitting edge 16 and is adapted to receive an impact of momentum thereon to drive the wedge means 12 in the opposite direction and into the log 10 for splitting thereof. To facilitate the transfer of momentum to the abutment surface 14 of the wedge means 12 a shaft member 18 is fixedly secured with respect thereto. An annular member 20 of circular or square cross-section is slidably engaged with respect to the shaft member 18. To facilitate this slidable engagement a central bore 22 is defined within the annular member. The diameter of this central bore 22 is such as to receive snugly the shaft member 18 therein to thereby allow slidable engagement between annular member 20 and the shaft member 18.

A weight means 26 is secured with respect to the annular member 20 such that downward movement of the annular member towards the wedge means 12 will provide an increase impact or momentum transfer into the wedge means. A weight retaining bracket means 28 is fixedly secured with respect to the annular member 20 and is also secured with respect to the weight means 26. The securement to the weight means is detachable such that heavier or lighter weights can be inserted as desired. This detachable securement is achieved by the weight securement means 32 which is adapted to detachably secure the weight retaining bracket means 28 with respect to the weight means 26. The brackets themselves are secured by a bracket securement means 30 to the annular member.

The bracket securement means 30 may also extend through the walls of the annular member into a solid core member 24 positioned within the central bore 22 of annular member 20. This core member 24 is adapted to contact the upper end of the shaft member 18 for impact driving of the wedge means 12. This contacting comprises the upper impact means 34.

Upper impact means 34 comprises a first upper impact surface 36 which is the lower end or surface 40 of core member 24. Upper impact means 34 also includes a second upper impact surface 38 which is the upper end 42 of shaft member 18. Upon downward movement of the annular member 20 with respect to the shaft member 18 contact will be achieved between the first upper impact surface 36 and a second upper impact surface 38 causing the transfer of momentum from the annular member 20 and therefore also from the weight means 26 into the wedge means 18 to cause slidable driving thereof into the log 10.

In order to further facilitate the driving of wedge means 12 a lower impact means 44 is designed by the slidable log splitter device of the present invention. This lower impact means comprises a first lower impact surface 46 which is the lower end 50 of annular member 20. A second lower impact surface 48 is also defined by the lower impact means 44 to be a surface of the wedge means 52 most likely the abutment surface 14 thereof. Alternatively, it could be a removable wedge spacer means 54 shown as a washerr-type configuration in FIG. 2. Regardless of the choice of the second lower impact surface the contact between the first lower impact surface 46 and the second lower impact surface 48 will further facilitate the transfer of momentum from the annular member 20 and the weight means 26 to the wedge means 12 and in particular to the splitting edge 16 thereof. It is particularly critical that the distances between parts of the present invention be chosen correctly such that impact of the upper impact means 34 and the lower impact means 44 will occur exactly simultaneously. This simultaneous impacting will be created by making the distance 56 between the first upper impact surface and the first lower impact surface be identical to the distance 58 between the second upper impact surface and the second lower impact surface. With this particular distance of chosing the simultaneous impacting will prevent deterioration of the impacting surfaces and also enhance the transfer of momentum between the slidable members and the fixedly positioned wedge means 12.

While particular embodiments of this invention have been shown in the drawings and described above, it will be apparent that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A sliding log splitter device comprising:

(a) a wedge means adapted to be forcibly inserted into a wooden log to cause splitting thereof, said wedge means including an abutment surface and a splitting edge;

(b) a shaft member being fixedly secured with respect to said abutment surface of said wedge means and extending upwardly and outwardly therefrom, said shaft member being solid and of generally cylindrical cross-section;

(c) an annular member being generally cylindrically shaped and longitudinally hollow and defining a longitudinally extending central bore therein of a cross-sectional internal dimension greater than the cross-sectional external dimension of said shaft member to allow said shaft member to extend into said central bore to be slidably movable therealong with respect to one another and removable with respect to one another;

(d) a core member fixedly secured within said central bore to be selectively movable with respect to one end of said shaft member as said annular member is moved longitudinally therealong with said central bore extending about said shaft member;

(e) a weight means detachably secured with respect to said annular member to control momentum to said annular member;

(f) a weight retaining bracket means to detachably secure said weight means with respect to said annular member;

(g) a bracket securement means for securing said weight retaining bracket means with respect to said annular member, said bracket securement means also serving to secure said core member with respect to said annular member;

(h) a weight securement means for detachably securing said weight means with respect to said weight retaining bracket means;

(i) an upper impact means for transmitting the momentum of said weight means to said wedge means, said upper impact means comprising;

(1) a first upper impact surface comprising one end of said case member; and (2) a second upper impact surface comprising an end of said shaft member opposite from the location of fixed securement with respect to said wedge means, said second upper impact surface adapted to be impacted by said first upper impact surface upon movement along said core member toward said wedge means;

(j) a lower impact means for transmitting the momentum of said weight means to said wedge means, said lower impact means comprising:

(1) a first lower impact surface comprising the end of said annular member opposite from the location of securement of said weight means; and (2) a second lower impact surface comprising a surface of said wedge means, said second lower impact surface adapted to be impacted by said first lower impact surface upon movement of said annular member along said core member toward said wedge means, said first upper impact surface and said first lower impact surface being spaced from one another at a distance equal to the spatial separation between said second upper impact surface and said second lower impact surface to cause simultaneous contact of said upper impact means and said lower impact means to facilitate transfer of momentum from said weight means to said edge means; and (k) a removable wedge spacer means positioned adjacent said wedge means and extending about said shaft member in contact with said abutment surface thereof, the side of said wedge spacer means opposite from said abutment surface providing said second lower impact surface, said wedge spacer means providing adjustment capabilities to maintain said second lower impact surface spaced apart at a distance equal to the spatial separation between said first upper impact surface and said first lower impact surface.

* * * * *